US005809210A

United States Patent [19]

Moore et al.

[11] Patent Number: 5,809,210

[45] Date of Patent: Sep. 15, 1998

[54] PHOSPHORESCENT HUMIDIFIERS AND VAPORIZERS

[75] Inventors: Devin Lee Moore, Decatur, Ga.; James E. Berkeley, Hattiesburg, Miss.

[73] Assignee: Sunbeam Products, Inc., Delray Beach, Fla.

[21] Appl. No.: 372,934

[22] Filed: Jan. 13, 1995

[51] Int. Cl.[6] ..... F24F 3/14; A01G 13/06; C09K 11/00; F21V 33/00

[52] U.S. Cl. ..... 392/402; 392/386; 264/21; 362/154; 261/DIG. 65

[58] Field of Search ..... 392/386, 390, 392/393, 398, 400, 401, 402, 403; 446/219, 267; 264/21; 362/101, 84, 154; 126/113; 237/78 R; 261/130, DIG. 29

[56] References Cited

U.S. PATENT DOCUMENTS

| | | | |
|---|---|---|---|
| 2,585,106 | 2/1952 | Frank | 21/118 |
| 2,840,682 | 6/1958 | Rubenstein et al. | 219/40 |
| 3,188,007 | 6/1965 | Myklebust | 239/215 |
| 3,456,043 | 7/1969 | Emery | 264/21 |
| 3,780,260 | 12/1973 | Elsner | 392/402 |
| 3,809,374 | 5/1974 | Schossow | 261/130 |
| 3,872,280 | 3/1975 | Van Dalen | 219/271 |
| 3,902,617 | 9/1975 | Valyi . | |
| 4,247,042 | 1/1981 | Schmanski et al. | 239/43 |
| 5,092,809 | 3/1992 | Kessler | 446/219 |
| 5,270,100 | 12/1993 | Giglio | 428/195 |
| 5,330,195 | 7/1994 | Gulick | 273/213 |
| 5,427,708 | 6/1995 | Stark | 446/73 |
| 5,437,410 | 8/1995 | Babasade | 239/55 |

FOREIGN PATENT DOCUMENTS

| | | | |
|---|---|---|---|
| 2539606 | 7/1984 | France | 362/101 |

*Primary Examiner*—Teresa J. Walberg
*Assistant Examiner*—Sam Paik
*Attorney, Agent, or Firm*—Dennis M. Carleton

[57] ABSTRACT

A phosphorescent assembly for humidifiers and vaporizers that enables the vaporizers and humidifiers to be easily seen in dark or dimly lit areas. The presently preferred embodiment of the invention provides for the water reservoir in both the humidifiers and the vaporizers to be blow-molded from a phosphorescent, plastic material that will be luminescent for several hours after being exposed to radiation within the light frequency spectrum.

13 Claims, 2 Drawing Sheets

PHOSPHORESCENT HUMIDIFIERS AND VAPORIZERS

BACKGROUND OF THE INVENTION

1. Field of the Invention

This invention relates to the use of phosphorescent agents in both humidifiers and vaporizers such that the humidifiers and the vaporizers glow-in-the-dark. More particularly, this invention concerns the apparatus and the method of making a phosphorescent, plastic reservoir for use in humidifiers and vaporizers.

2. Description of Related Art

Both conventional humidifiers and conventional vaporizers are known to be used to provide moisture to the ambient air in homes, offices, etc. Typically, a portable humidifier comprises a plastic water reservoir, a cover with an air outlet and humidifying apparatus. The humidifying apparatus may include a motor, a water pump driven by the motor, a sprayer being a rotatable disc also driven by the motor and a device for moving the water which is discharged by the pump onto the disc and through the air outlet into the atmosphere. An example of this type of humidifier is disclosed in U.S. Pat. No. 3,188,007 issued to P. Myklebust.

Typically, a vaporizer comprises a plastic reservoir with an outlet and a heating device positioned within the reservoir as is described in U.S. Pat. No. 2,840,682 issued to R. Rubenstein et al. The heating device can take the form of four side-legs forming a rectangle with an opening in the middle. Two opposing side-legs are insulating members and the other two opposing side-legs are electrode members. When the reservoir is filled with water and a voltage source is connected to the heating device, a current will flow between the electrode members through the water in the opening. The flow of current in the opening will heat the water thus, vaporizing the water.

Further, it is known for a vaporizer to possess an electrically powered light. Specifically U.S. Pat. No. 2,585,106 issued to W. R. Frank discloses a vaporizer which uses a pilot light on a side of a vaporizer to indicate when the heating unit is in operation. The pilot light is illuminated and the heating unit is turned on when the rheostat switch closes the electrical circuit allowing the current to flow through the electrical circuit.

U.S. Pat. No. 3,872,280 issued to Van Dalen discloses another vaporizer having a electrical powered light wherein the light functions both to indicate that the vaporizer is on and operational and to act as an auxiliary light source. The vaporizer is a two-piece device with a base portion and an annular container. The base portion includes a heating element and an electrical light source. Located within the interior of the annular container are carrier members for the substance to be vaporized. The annular container is positioned on the base portion and the base portion is connected to an electrical wall outlet such that the heating element will vaporize the substance contained within the annular container. When the base portion is plugged into the electrical wall outlet, the light will be illuminated.

As well as serving as an auxiliary light source and a signal that the vaporizer is in operation, an electrical light in a vaporizer can also serve as a heater for vaporizing a liquid as described in U.S. Pat. No. 3,780,260 issued to Elsner. Elsner discloses a combination night light and liquid vaporizer comprising a plastic bracket and a plastic container-dispenser mounted on the bracket. Two prongs extend from the bracket such that the combination night light and liquid vaporizer is mounted on the wall when in operation. An electric lamp is mounted on the plastic bracket and extends within the container-dispenser such that the lamp heats the liquid within the container-dispenser and provides light which is emitted through the container-dispenser.

One problem with the conventional vaporizers and humidifiers discussed above is that they cannot be readily seen in a dark room. Often a vaporizer or humidifier is placed in a bedroom during the night while the user is sleeping. In the instance where the prior art vaporizer or humidifier is not operational, no light will be provided. All of the lights provided in the prior art mentioned above are only lit when the vaporizers and humidifiers are plugged into the wall or are in operation. A user awaking from sleep who does not turn on a light may fall over the vaporizer or humidifier or the electrical cord because they could not see the vaporizer or humidifier in the dark room. Even if the vaporizer or humidifier is operational and the electric light is illuminated, the light may be faced away from the user or the light may not be bright enough to provide enough light so that the user can identify the vaporizer. In the case where a user overturns a vaporizer, the user may be burned by the boiling water in the reservoir.

The prior art teaches a method for making luminous plastic articles in U.S. Pat. No. 3,456,043 issued to D. B. Emery. The method comprises injection molding a plastic material having cavities shaped in a desired design, placing luminous material within the cavities, sealing the luminous material within the cavities and injection molding a second plastic material over the first plastic material. Emery uses the method to provide luminous indicia on automobile dashboards and other instrument panels. Emery does not teach using his method to provide enough illumination to make a vaporizer or humidifier identifiable in a dark room.

Another non-related object is disclosed as having phosphorescent materials applied thereto in U.S. Pat. No. 5,330,195 issued to Gulick. In this patent a phosphorescent material in a liquid state is applied to the exterior surface of a golf ball and is then sealed to the golf ball surface with a transparent coating. As is apparent, the object being coated with the phosphorescent material is not a humidifier or vaporizer but rather a golf ball.

Nowhere in the prior art mentioned above is there disclosed a humidifier or vaporizer having a phosphorescent material that will glow-in-the-dark both while the vaporizer or humidifier is in operation and while the vaporizer or humidifier is not in operation. Further, the prior art mentioned above does not disclose a vaporizer or humidifier that provides a sufficient amount of light to enable the user to identify the vaporizer or humidifier in a dark room. Thus, there is a definite need for a glow-in-the-dark or phosphorescent humidifier and vaporizer that will prevent a user walking in a dark room from falling over and overturning the humidifier or vaporizer and injuring himself.

SUMMARY OF THE INVENTION

Accordingly, the presently preferred disclosure provides humidifiers and vaporizers that will glow-in-the-dark and a method of making the same wherein the glow-in-the-dark humidifiers and vaporizers can be seen in dark or dimly lit areas preventing a user walking in the dark from tripping over a humidifier or a vaporizer and injuring himself.

The presently preferred invention provides phosphorescent humidifiers and vaporizers that will glow-in-the-dark whether or not the humidifiers or vaporizers are in operation. Further, the presently preferred invention provides phosphorescent humidifiers and vaporizers that will glow-in-the-dark without electrical power.

The presently preferred invention provides that the humidifiers and vaporizers be made having a sufficient amount of exterior surface area that is phosphorescent such that the humidifiers and vaporizers can be seen in the dark. The presently preferred embodiment of the invention provides a water reservoir of either a humidifier or a vaporizer to be made of phosphorescent material. Preferably, the water reservoir is made of a plastic material that is transparent or translucent such that the phosphorescent agent contained within the plastic can best be emitted therefrom and easily seen by a person in a dark area. Other means may be used to make the water reservoir glow-in-the-dark such as coating a plastic reservoir for a humidifier or a vaporizer with phosphorescent paint. Furthermore, other portions of the humidifier or the vaporizer can be made of the phosphorescent material such as the power cord, the humidifier humidifying apparatus or the vaporizer electrode housing.

Although other molding processes such as injection molding can be used to make the water reservoir, the presently preferred method of making the plastic reservoir is a blow molding process.

Other details, objects and advantages of the presently preferred invention will become more apparent as the following description of a presently preferred embodiment and presently preferred method of making the same proceed.

BRIEF DESCRIPTION OF THE DRAWINGS

The accompanying drawings show a presently preferred embodiment of the invention in which.

DETAILED DESCRIPTION OF THE PRESENTLY PREFERRED EMBODIMENTS

Although this invention is suitable for use in a variety of other devices as noted above, it will be described in relation to use with a steam vaporizer and a humidifier. Such description is solely for the purpose of explanation and is not intended to limit the scope of this invention.

Figure 1:
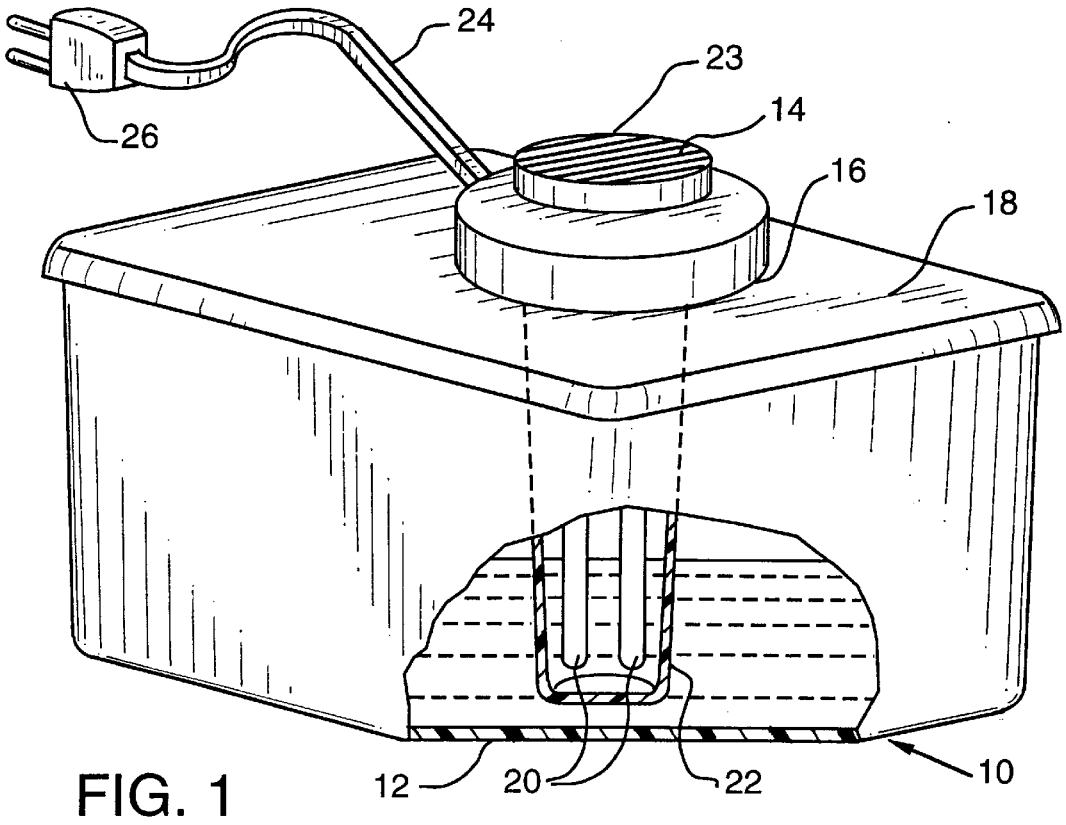
FIG. 1 is a perspective view of the presently preferred embodiment of a vaporizer having a phosphorescent reservoir.

FIG. 1 illustrates a vaporizer 10 having a water reservoir 12 and a heating unit 14. Although the reservoir 12 is shown in the shape of a three-dimensional rectangle, the reservoir 12 can take the form of many other configurations such as frusto-conical or cubical. The water reservoir 12 has an opening 16 on its top surface 18. The heating unit 14 extends through the reservoir opening 16 into the interior of the reservoir 12 which is filled with water. The heating unit 14 has a pair of electrodes 20 which are attached to and extend from an electrode holder 21 (not shown). The electrodes 20 are substantially parallel to one another and extend within an electrode housing 22. The structure of the electrode housing 22 allows for the electrodes 22 to come into contact with the water in the reservoir. An aperture 23 is provided in the top of the heating unit 14.

The water reservoir 12 is made from a plastic material containing a phosphorescent agent. Preferably, the plastic material is high-density polyethylene which is translucent; however, the reservoir could be made from other plastic materials such as polycarbonate which is transparent. Mixtures of plastic materials and other plastic material, such as ABS, could also be employed as will now be readily apparent to those of ordinary skill in the art. One of a transparent plastic material or a translucent plastic material should be chosen for the plastic material in order that the phosphorescent reservoir emit light in the most optimum manner. If the reservoir 12 is a solid material the phosphorescent agent will not emit light as brightly or clearly. Although, the phosphorescent agent could be any phosphorescent agent that would result in the vaporizer glowing-in-the-dark, preferably the phosphorescent agent is colorized phosphorescent pellets such as those identified as SX9-0220 Phosphorescent which can be obtained from Phoenix Color & Compounding, Inc. in Sandusky, Ohio.

One end of an electrical wire 24 extends from the heating unit 14. The other end of the electrical wire 24 has an electrical plug 26 for plugging the wire 24 into an electrical wall outlet (not shown). In operation, the electrical plug 26 is plugged into the electrical wall outlet and a source of current from the electrical wires passes between the electrodes and through the water. The water will be heated and thus, vaporize into steam. The steam will be emitted from the electrode housing 22 through the aperture 23 of the heating unit 14 into the atmosphere. As noted above, the reservoir will glow-in-the-dark regardless of whether the electrical wire 24 is plugged into the electrical wall outlet and whether or not the vaporizer is in operation.

The preferred method of making the reservoir is by blow molding using a blow molding machine such as Model No. E90 which is manufactured by Cincinnati Milacron, Inc. of Cincinnati, Ohio. First, the plastic material is blended with the colorized phosphorescent pellets to produce a resultant mixture. Preferably, the phosphorescent agent is present in the amount of about one percent by weight of the total resultant mixture. The resultant mixture is then fed into the blow molding machine by a screwing action where the resultant mixture is heated until it is in a liquid state. The resultant mixture is then extruded in the shape of a sleeve from an extruder into the mold which is in the desired shape of the vaporizer reservoir. The temperature at the parisan, the extruder head, is approximately between 375 and 390 degrees Fahrenheit. Pressure is then directed inside of the sleeve such that the sleeve expands and the exterior walls of the sleeve come into contact with the interior walls of the mold and the desired shape of the reservoir 12 is obtained. The reservoir 12 is then allowed to cool. After the reservoir and the mold have cooled, the reservoir 12 is withdrawn from the mold. Once outside of the mold, the reservoir 12 is exposed to radiation within the light frequency spectrum preferably, ultra-violet light and thereafter will glow-the-dark for several hours.

The selection of the temperature of the resultant mixture at the parisan as well as the time for cooling the mold depend on the type of plastic material and phosphorescent agent being used, the size and configuration of the mold and other environmental factors. Although the above blow-molding process is the presently preferred manner of making the phosphorescent vaporizer, many other processes and variations thereof may be utilized to make a phosphorescent assembly for a vaporizer. For instance, the reservoir 12 can also be molded by an injection molding process.

Figure 2:
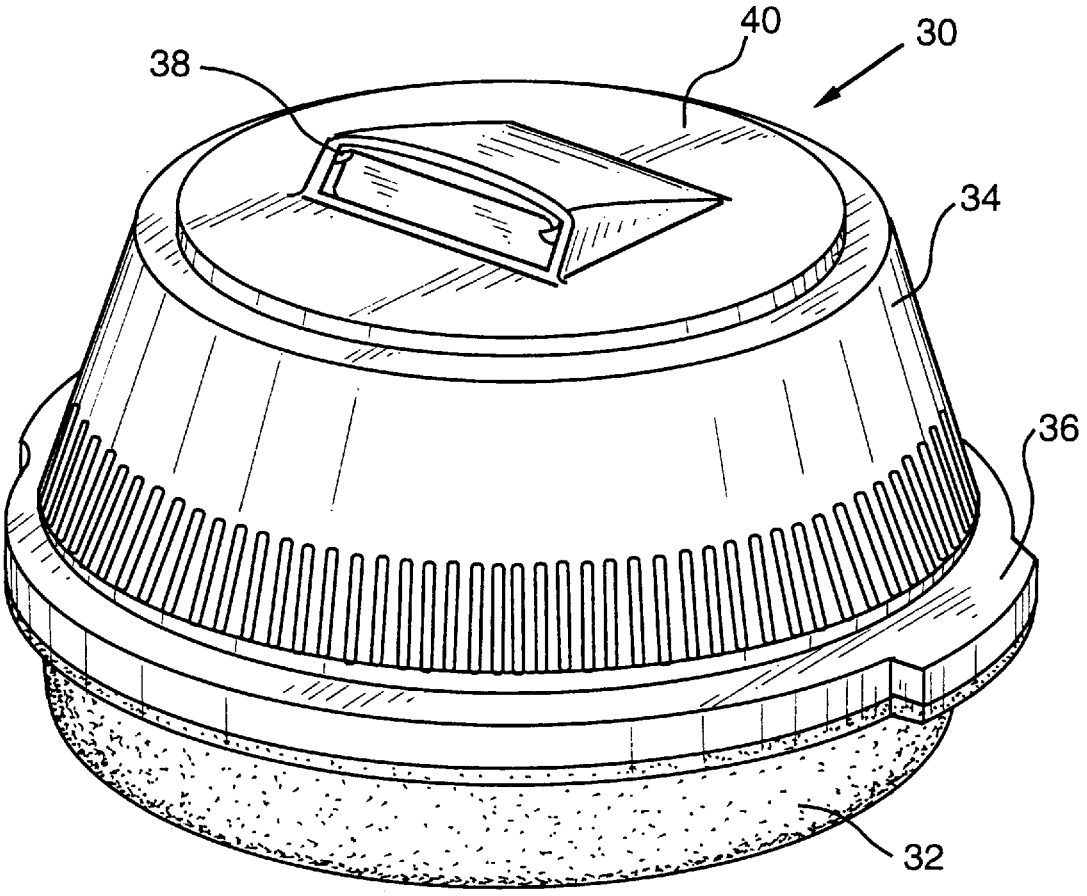
FIG. 2 is a perspective view of a second presently preferred embodiment of a humidifier having both a phosphorescent housing and a phosphorescent container.

FIG. 2 illustrates a humidifier 30 having a container 32, a housing 34 and conventional humidifying apparatus (not shown) located within the housing 34. The humidifying apparatus may include a motor, a water pump, a sprayer and a device for transmitting water into the atmosphere. The container 32 is substantially cylindrical having a handle 36 along the circumference. The housing 34 is frusto-conical having an outlet port 38 on the top surface 40 of the housing 34. Both the housing 34 and the container 32 are preferably made of phosphorescent material described above. Although it is preferred to make both the housing 34 and the container from a blow-molding process an injection molding process could be used.

While the presently preferred embodiment and presently preferred method of the invention have been described herein, it is distinctly understood that the invention is not limited thereto but may be otherwise variously embodied within the scope of the various claims.

We claim:

1. An electrical device comprising:

(a) a means for actively providing moisture to ambient air selected from the group consisting of a vaporizer and a humidifier; and (b) a portion which is luminous for several hours after being exposed to radiation within the visible light frequency spectrum, comprising a phosphorescent material.

2. The device of claim 1 wherein said portion which is luminous for several hours is a water reservoir.

3. The device of claim 1 wherein the phosphorescent material is a mixture of a plastic component and a colorized phosphorescent component.

4. The device of claim 3 wherein the colorized phosphorescent component is about one percent by weight of the total phosphorescent material.

5. The device of claim 3 wherein the plastic component is high-density polyethylene.

6. The device of claim 3 wherein the plastic component is polycarbonate.

7. The device of claim 3 wherein the water reservoir is formed by a blow-molding process.

8. The device of claim 2, wherein the means for providing moisture to ambient air is a vaporizer further comprising:

a heating unit and apparatus for supplying power to the heating unit, wherein the heating unit extends within the water reservoir through an opening therein.

9. The device of claim 8 wherein the heating unit further comprises a pair of electrodes mounted within an electrode housing wherein the electrodes are able to contact water within the reservoir.

10. The device of claim 2, wherein the means for providing moisture to ambient air is a humidifier further comprising:

a. a motor;

b. a water pump driven by said motor;

c. a sprayer, being a rotatable disk also driven by said motor; and d. a device for moving water discharged by said water pump onto said sprayer into the ambient air.

11. The device of claim 1 wherein the luminous portion is an electrical power cord.

12. A humidifier comprising:

(a) a container;

(b) humidifying apparatus; and (c) a housing for accommodating the humidifying apparatus, wherein the housing is made of phosphorescent material which is luminous for several hours after being exposed to radiation within the visible light frequency spectrum.

13. A vaporizer comprising:

(a) a water reservoir defining an opening and being comprised of a plastic material containing a phosphorescent agent which is luminous for several hours after being exposed to radiation within the visible light frequency spectrum; and (b) a heating unit which extends through the reservoir opening and comes into contact with water in the reservoir.

* * * * *